United States Patent [19]

Becker

[11] Patent Number: 4,558,996

[45] Date of Patent: Dec. 17, 1985

[54] EASY LOAD PERISTALTIC PUMP

[75] Inventor: Harold D. Becker, Oklahoma City, Okla.

[73] Assignee: Organon Teknika Corporation, Oklahoma City, Okla.

[21] Appl. No.: 510,075

[22] Filed: Jun. 30, 1983

[51] Int. Cl.[4] ..... F04B 43/12; F04B 45/08

[52] U.S. Cl. ..... 417/374; 417/477

[58] Field of Search ..... 417/477, 476, 475, 374

[56] References Cited

U.S. PATENT DOCUMENTS

| | | | |
|---|---|---|---|
| 2,035,159 | 3/1936 | Henry | 417/476 X |
| 2,679,807 | 6/1954 | Bruckmann | 417/476 X |
| 4,189,286 | 2/1980 | Murry et al. | 417/477 |

*Primary Examiner*—Richard E. Gluck

*Attorney, Agent, or Firm*—Tom R. Vestal; David M. Carter; Francis W. Young

[57] ABSTRACT

There is provided a peristaltic pump which has a base member and a rotor attached to the base member. The rotor is adapted to receive a resilient collapsible tube. The pump further includes a stator having a fixed member disposed in a permanent position relative to the rotor. A door stator is connected to the fixed stator, and the entire stator will confront the periphery of the rotor over at least uninterrupted 180° concave surface. A latch is provided on the door stator, so that it may pivot outward for ease of removal of the tubing.

23 Claims, 17 Drawing Figures

EASY LOAD PERISTALTIC PUMP

BACKGROUND OF THE INVENTION

1. Field of the Invention

The instant invention relates to peristaltic pumps in both design and operation. Peristaltic pumps have advantageous characteristics which cause them to be used widely, especially in the medical field, e.g., blood dialysis. In particular, the invention relates to improvements in peristaltic pumps relating to the loading of said pumps, and the adaptation of those pumps in blood dialysis equipment.

2. Description of the Prior Art and Other Information

Peristaltic pumps, the type wherein the plurality of roller elements move along the inner race of a cylindrical or semi-cylindrical stator casing in order to pump a fluid through a compressible plastic tube, having the requisite resiliency or memory, by means of intermittent compression and expansion reactions generated within the tube are, of course, well known, e.g., U.S. Pat. No. 3,756,752 to Stenner. Great efforts have been made in the art for a number of years in order to improve the simplicity of operation of peristaltic pumps for hospital and laboratory operation in terms of pump efficiency, and finally, of loading of the pumps. It is generally true that most peristaltic pumps in terms of loading require two hands and a fair amoung of brute force in order to get the tubing in place and locked prior to operation of the pump.

For example, the pump disclosed in columns 1 and 2 in FIG. 1 of U.S. Pat. No. 3,791,777 to Papoff et al. comprises a plurality of tubing channels that are adjustable individually for tubing size and plurate. Clearly, they do not open for easy tubing insertion. Likewise, Hogan, U.S. Pat. No. 4,211,519 discloses a peristaltic pump having two identical hingedly connected housing sections; the housing sections require tools to remove and to open the pump for tubing replacement. Moreover, this concept does not allow visual observation of the flow tube. Hein, U.S. Pat. No. 4,239,464 discloses a blood pump comprising an inlet valve, an outlet valve, and a displacement chamber being portions of a common flexible tubing being squeezable between fixed wall and two spaced, movable valve plungers and a displacement plunger arranged on a portion of a tubing therebetween, wherein the valve plungers in the flow direction of the tubing have a dimension exceeding 5 mm, and that in the tubing, with the valve plungers in closed position, a slot is left with a height less than 0.5 mm. The Hein concept applies plate pressure to tubing with quick release to create a vacuum; however, the Hein concept does not contain a rotor or stator for circular occlusion of the flexible tubing.

Lamadrid et al. U.S. Pat. No. 4,256,442 discloses a peristaltic pump including a pivotably mounted pressure plate which, together with a pump roller elements, defines a pump chamber. The mounting system for the pressure plate includes a mechanically-advantaged four-bar linkage arrangement which is said to automatically retain the pressure plate in either its fully open or fully closed position as a result of an over-center type locking construction. In operation, Lamadrid et al. stretches tubing over rotor rollers to provide occlusion pressure. The pivotal member operates very much like a suspender with a belt. A backup pivotal member only comes into play after the tubing becomes stretched sufficiently to provide no tension on the rotor rollers.

Cosentino et al. U.S. Pat. No. 4,363,609 discloses a blood pump system in which a roller pump is provided for pumping blood through a flexible tube. An electrical control circuit is connected to a DC motor having an output shaft for applying the necessary voltage to drive the motor at a predetermined speed. Gearing means are provided connecting the motors' output shaft to drive the roller pump. The pump system of Costenino et al. has a cover which is held in place by the use of two magnets. However, it is also apparent from a review of the '609 patent that the cover is not intended to operate in conjunction with a hinge stator as the tubing is placed on the inside of a specifically confined arcuate bearing surface and two rollers are spring pressed into the tubing. The right side of the Cosentino et al. pump is so configured to act as a tubing retainer that is not pivotal or removable.

Generally speaking, all peristaltic pumps must hold occlusion with one or more rollers until another roller(s) closes the tubing on the next pump stroke. This is preferably done with a "ramp" type of approach to eliminate shock to the pump parts and tubing.

U.S. Pat. No. 4,138,205 to Wallach discloses a peristaltic pump having two stator members pivotably disclosed on diametrically opposite sides of a pump rotor. When in their closed position, the two inside faces of the stator members form an arcuate surface against which the peristaltic tubing rests. To replace the tube, the stator members are first unlocked by turning two hand levers with the stator members, and then swung apart.

Guttmann discloses in U.S. Pat. No. 4,179,249 a quick loading peristaltic pump similar to the one according to the Wallach teaching. The Guttmann pump includes a pair of reaction members pivotably mounted on a base plate for movement between open and closed positions relative to rotor, the reaction members being releasably retained in their closed positions by a locking plate. The compressible tube partially encircles the rotor and has its ends releasably engaged by clamping which prevents axial movement of the tube and is adapted to accommodate tubes of different diameter. Unlike the Wallach pump and its two hand levers, the two pivotal stator members of Guttman are locked in their closed position by means of a swingable locking plate. Wallach and Guttman are typical of the prior art easy loading peristaltic pumps which incorporate two pivotable stator members.

Of lesser interest are the prior art patents to Calvet, U.S. Pat. No. 4,131,399; Grimsrud, U.S. Pat. No. 4,190,536; Savitz et al., U.S. Pat. No. 4,229,299; Hogan, U.S. Pat. No. 4,315,718; Meyer et al., U.S. Pat. No. 4,218,197; and Dellabianca, U.S. Pat. No. 4,060,348. Note also FIG. 1 of U.S. Pat. No. 4,108,575 and the supporting disclosure of Schal. See also recent literature of Sartorius GmbH, P.O. Box 19, D-3400 Gottingen, West Germany, relating to its HEMOPROCESSOR ® easy closing blood pump; and G. A. Carlson et al., "A Portable Insulin Infusion System With a Rotary Cellonoid-Driven Peristaltic Pump", MED. PROGR. TECHNOL. 8 at 49–56 (1980).

Of still lesser interest are Terman et al., U.S. Pat. No. 4,215,668; Tregoning, U.S. Pat. No. 4,319,568; Judson et al., U.S. Pat. No. 3,489,145; Diggins, U.S. Pat. No. 4,333,088; Unger et al., U.S. Pat. No. 3,858,796; Rotta, U.S. Pat. No. 3,862,629; Brumfield, U.S. Pat. No.

3,768,653; Unger et al., U.S. Pat. No. 3,724,747; Bellhouse et al., U.S. Pat. No. 4,328,102; Clemens, U.S. Pat. No. 4,119,046; Hutchisson, U.S. Pat. No. 4,083,777; Cosentino et al., U.S. Pat. No. 4,221,543; Nathan et al., U.S. Pat. No. 4,196,729; Terman et al., U.S. Pat. No. 4,223,672; Xanthopous, U.S. Pat. Des. No. 264,134; and Buckberg et al., U.S. Defensive Publication T 994,001. Note also K. Ayukawa et al., "Stream Lines and Path Lines in a Channel Acting as a Peristaltic Pump", TRANS. (JAPAN) SOC. MECH. ENG. 46 (410b) at 1916–1924 (1980) and C. G. Adem et al., "Variations in Vascular Resistance of Isolated Rat Hearts During Normothermic and Hypothermic Experiments", J. BIOMED. ENG. 3 (2) at 128–133 (April 1981).

3. The Problem

As is demonstrated by the prior art cited above, there has, for quite some time, been a need for a peristaltic pump for the hosiptal and biochemical laboratory which is truly easy loading, i.e., does not require two hands and a large amount of force to get the tubing in place and locked prior to operation. Also, it would be desirable to have the peristaltic pump's rotor available for easy cleaning after periodic use through submersion in cleaning fluids, either by lay persons or hospital personnel. Further, it would be advantageous to minimize the number of moving parts employed in a peristaltic pump, and in particular to minimize absolutely the number of parts, e.g., ball bearings, which must be replaced periodically due to normal pump wear. It would also be desirable to provide a pump in which the fluid moved through the occludable tube could be observed at all times. Finally, it would be most advantageous to provide a pump incorporating only one pivotal stator member.

SUMMARY OF THE INVENTION

Disclosed herein is a peristaltic pump which overcomes the recited problems of the prior art and constitutes a truly dramatic advance in easy loading peristaltic pumps applicable to a great number of purposes in the chemical laboratory and hospital.

The novel peristaltic pump comprises:

(a) base member;

(b) rotor disposed on said base member, said rotor being rotatable about a longitudinal axis normal to said base member, and adapted to receive a resilient collapsible tube having inlet and outlet sections placed about said rotor;

(c) stator comprising:

(1) fixed stator member disposed in a permenent position relative to said rotor and said collapsible tube, and adapted to receive door stator in tight-fitting engagement; and (2) door stator connected to said stator member and capable of being received by said fixed stator member in tight-fitting engagement, said stator having a concave face when the fixed stator and door stator are in tight-fitting engagement confronting the periphery of said rotor over at least about an uninterrupted 180° of said periphery so as always to provide within said concave face an occudably tight engagement for said resilient collapsible tube between said stator and said rotor regardless of the orientation of the rotor.

Preferably, the rotor is secured by and rotates around axle connected to said base member, said axle having a longitudinal axis normal to the base member.

Preferably the rotor has at least two arms for engaging the resilient collapsible tube in occudably tight engagement with said stator. Although the artisan can now envision 3, 4 or 5 arms for the rotor, two are sufficient in most applications of the instant invention. A much preferred embodiment, disclosed in more detail, infra, comprises rotor having two arms which engage the resilient collapsible tube by of spring loaded occluding rollers, each having an axis substantially parallel to the axis of said rotor, each constrained to predetermined limits of outward and inward movement, and capable of receiving collapsible tubes of varying sizes and material durometers. Further, it is preferable to have adjacent each arm two or more guide prefacing (in the direction of rotation) each arm, each of which guide restraining the resilient collapsible tube within predetermined limits of inward and outward movement along the axis of the rotor. The guide may comprise a roller secured about a pin normal and running through the axis of the rotor.

It is further preferred to provide a peristaltic pump as above, wherein the rotor is provided with emergency crank, comprising:

(a) lever engaging said rotor having an axis normal and running through the axis of the rotor and hingedly and pivotably connected to said rotor; and (b) knob about the periphery of said lever for manually cranking said in an emergency. The lever may be provided, preferably, with engagement for engaging on the axis of the rotor a power source for said peristaltic pump, e.g., a suitable DC motor, and for fixably securing in a predetermined alignment said peristaltic pump to said power source. The engagement may further preferably comprise a drive pin having an axis normal and running through the axis of the rotor where the drive pin engages and secures the power source. Most preferably, the lever is hingedly and pivotably connected to said rotor by pin affixed between two protruding bar which are adapated to received said lever in close fitting engagement, so as to transfer stress of the rotor and stress from the occlusion of the resilient collapsible tube from the pin to the rotor (see FIGS. 1, 6 and 13). Drive pin disengagement also extra power not required to turn the power source.

A peristaltic pump is further envisioned where the rotor engages the axle through bearing in close fitting engagement but capable of easy rotation about the axle. The base member may further comprise a shaft having a common axis as the axis of the motor and rotor, and adapted to accept in close fitting engagement a cylindrical bearing of the rotor. Most preferably, the bearing for the rotor comprises cylindrical sleeve rotatable about the shaft of the base member and secured tightly to the rotor, which sleeve are of a washable polyethylene having a molecular weight of from about $2\times10^6$ to about $5\times10^6$ so as to avoid frequent chemical lubrication.

Further, each of the spring loaded rollers may comprise cylindrical sleeve rotatable about the axis of said roller, for which each of the cylindrical sleeve are, again, of a washable polyethylene having a molecular weight of from about $2\times10^6$ to about $5\times10^6$ so as to avoid similar lubrication. Likewise, each roller of said guide for each arm of the rotor may comprise cylindrical sleeve rotatable about said pin, which cylindrical sleeve are of a washable polyethylene having a molecular weight from about $2\times10^6$ to about $5\times10^6$ so as to avoid similar lubrication. It can therefore be envisioned that all moving parts of the rotor engaging (1) the shaft of the base member and (2) resilient collapsible tubing are of high molecular weight polyethylene having the above indicated molecular weight so as to completely avoid the necessity of any conventional roller bearings whatsoever. In this manner, a peristaltic pump may be (1) so constructed of a minimum number of moving parts and then again (2) be capable of being used for a lengthy period of time and (3) be washable by lay persons or hospital or laboratory personnel.

The stator of my invention comprises fixed stator member and door stator member. The fixed stator member rests on top of the base member. The fixed stator member and base may comprise one integrated, continuous part of metal or suitable plastic.

It is further envisioned that the peristaltic pump of this invention has door stator hingedly and pivotably connected to the fixed stator (see Figures, especially FIGS. 5–6). In an alternate embodiment, the door stator may slidably connect to the fixed stator, although the first embodiment is most preferable. Most preferably, the fixed stator provides axle parallel to the axis of the rotor adapted to slidably receive in close fitting engagement hub of the door stator for hingedly and pivotably connecting the door stator to the fixed stator, although as the artisan may recognize, their respective roles could be reversed. As is indicated in the preferred embodiments, infra, the door stator may be secured to the fixed stator by one or more off-center toggle latches.

The novel peristaltic pump preferably has as its fixed stator two retaining orifices for receiving the inlet and outlet sections of said resilient collapsible tubing, each of said retaining orifices adapted to receive in tight-fitting engagement one pump segment fitting, or stop, which restricts movement of the resilient collapsible tube in or out of the stator. Preferably the pump segment fitting is permanently secured around the resilient collapsible tube (see FIGS. 6 and 11).

Although it is entirely possible to have the base member and the fixed stator made of two separate pieces of material, it is most preferable to make same so that they are comprised of one piece of continuous material, e.g., aluminum, titanium, nickel, stainless steel, or a suitable plastic. Aluminum and glass-filled injection-molded polycarbonate are most preferable materials for the base member and stator.

Although a lid is not necessary, preferably the peristaltic pump of my invention further comprises lid for covering said rotor, collapsible tube, and stator member when said pump is in operation. Said lid may be hingedly connected to said stator and adapted upon closing to fit in close engagement with the top of the side of the stator parallel and opposite to the base member when the door stator is in tight-fitting engagement with the fixed stator member. The lid may further comprise a window (see FIGS. 1 and 14) for viewing the operation of the rotor when the pump is in use. The lid may further comprise latch for locking said lid to the stator. The latch may comprise a magnet adapted to receive one or more engaging magnets permanently affixed in the stator. Most preferably, the lid is hingedly and pivotably connected to the door stator by remote offset hinge pivoting on an axis perpendicular to the axis of the rotor.

DESCRIPTION OF THE DRAWINGS

FIGS. 1–19 provide detailed illustrations of several preferred embodiments of the overall novel pump both along its axes and in perspective, as well as cross-sections of the rotor and an exploded view of the rotor.

Figure 1:
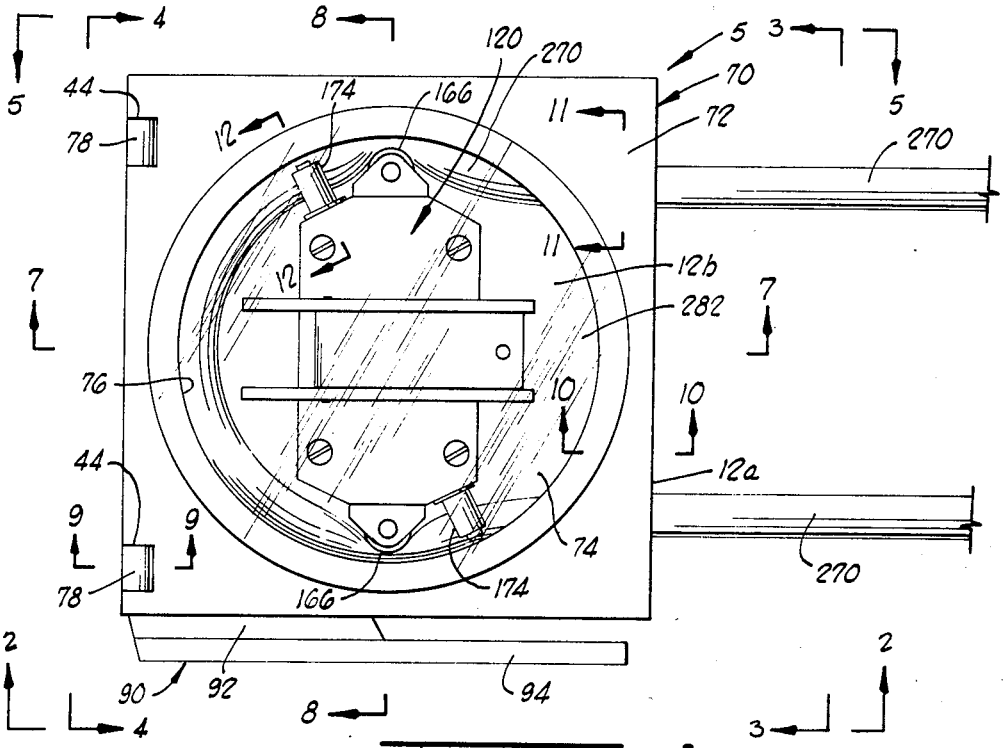

More specifically, FIG. 1 provides an elevational [vertical] view from above of the novel peristaltic pump of the instant invention as would be seen by an observer viewing same roughly along the axis of rotation of the rotor.

Figure 2:
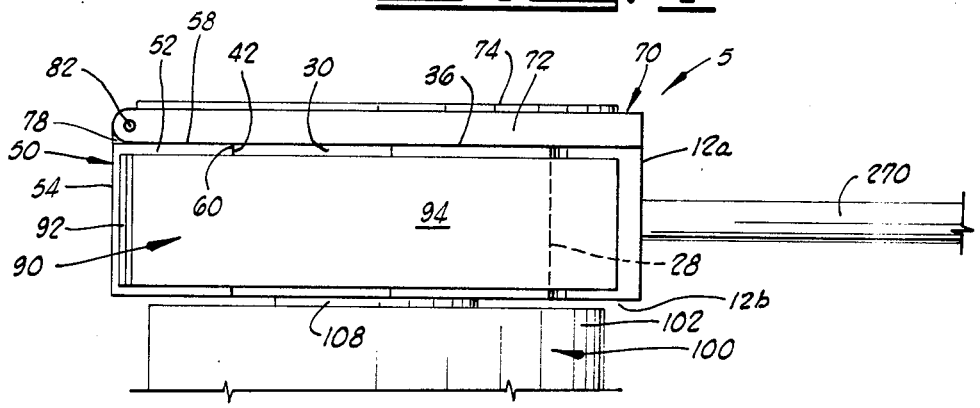

FIG. 2 provides an outside elevational horizontal view of the pump of FIG. 1 showing its relationship to a conventional DC motor, the view along the plane of tubing entering and coming out of the pump exiting the pump but perpendicular to the common axis of the tubing immediately entering and exiting the pump.

Figure 3:
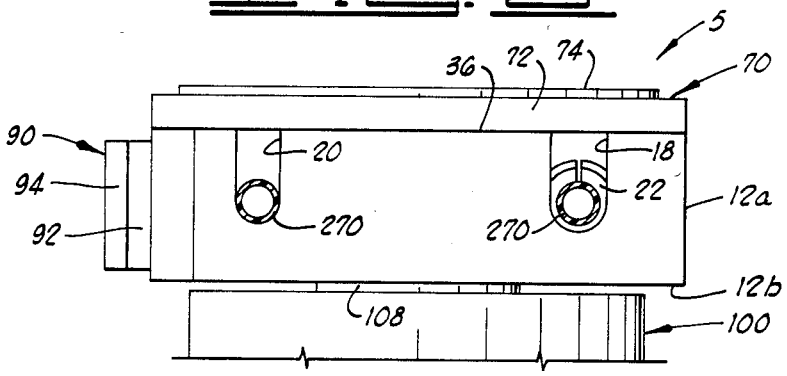

FIG. 3 is another elevational horizontal overall view of the pump of FIG. 1 along the axis of the tubing immediately entering and exiting the pump.

Figure 4:
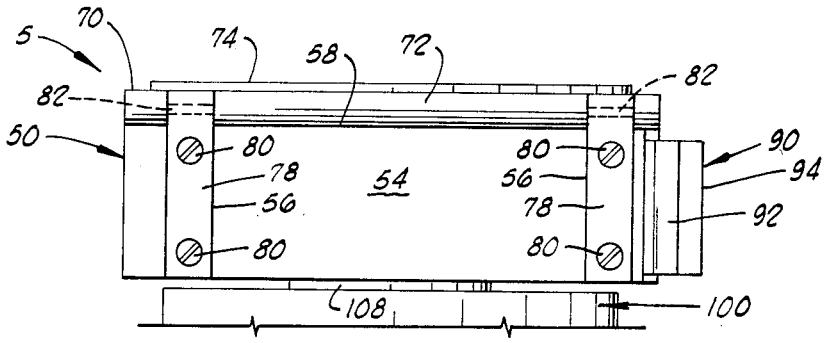

FIG. 4 is a horizontal elevational partially schematic view of the pump from the rear of the pump, this view 180° opposite the view of FIG. 3, illustrating one embodiment of how the lid may be secured to the door stator. Note FIGS. 15–17 for an alternate embodiment.

Figure 5:
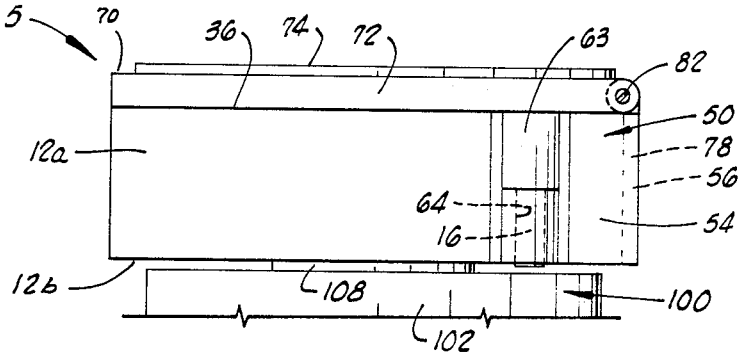

FIG. 5 shows a partly-sectional schematic view of the fixed stator member, door stator member and lid, and specifically, the relationship of the axle of the fixed stator member in operation with a hub within the fixed stator member.

Figure 6:
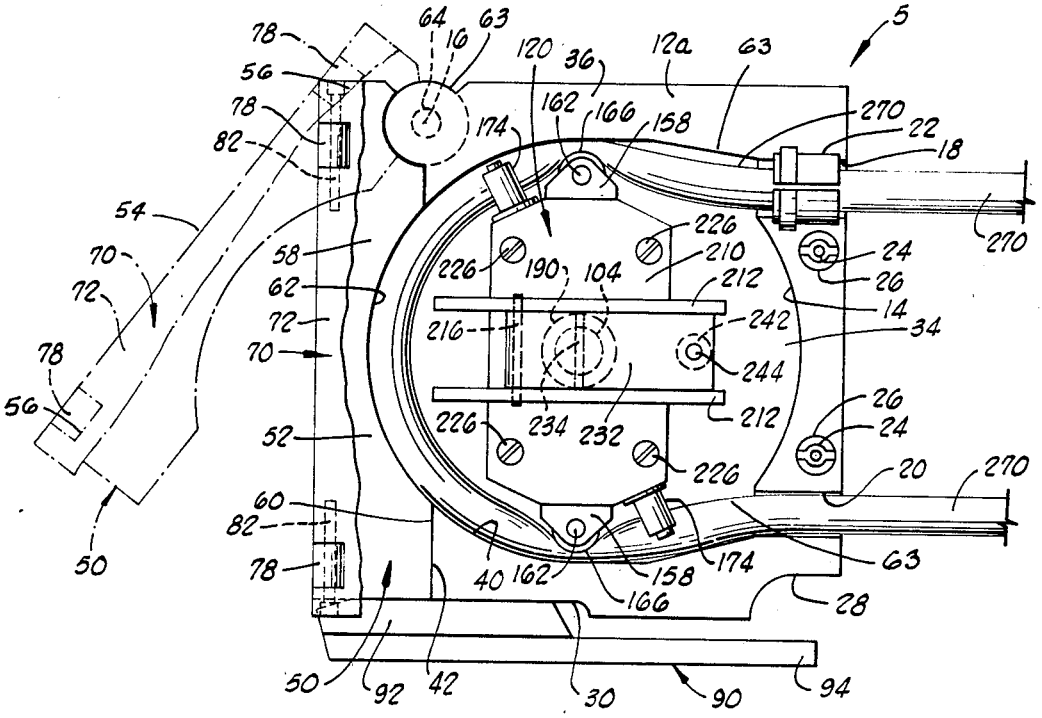

FIG. 6 provides a elevational [vertical] view from above (note FIG. 1) but also showing by schematic sections the operation of the door stator relative to the fixed stator member for loading and unloading the resilient collapsible tube from the pump.

Figure 7:
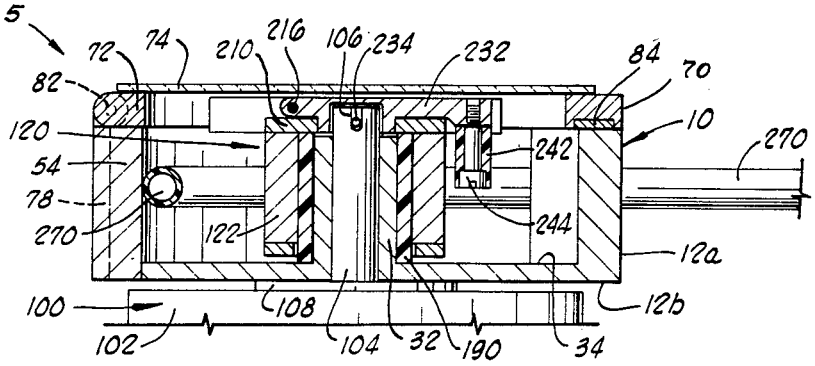

FIG. 7 provides a schematic sectional view from the horizontal (note FIG. 2) of the rotor, resilient collapsible tube and motor when the pump is in operation.

Figure 8:
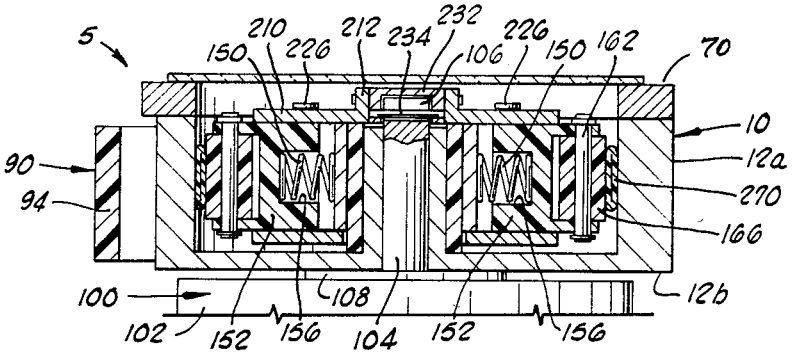

FIG. 8 is another horizontal sectional schematic from the front (note FIG. 3) showing the operation within the rotor of two spring-loaded occluding rollers capable of receiving collapsible tubes of varying sizes.

Figure 9:
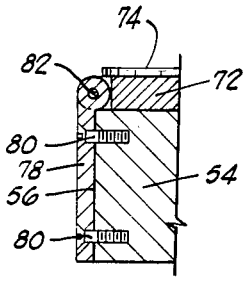

FIG. 9 shows a schematic sectional view from the horizontal of details of the lid of FIGS. 1–2 and its hinge vis-a-vis the door stator.

Figure 10:
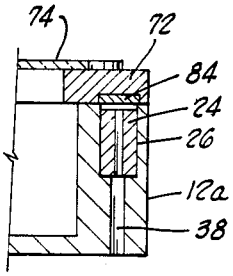

FIG. 10 shows a horizontal schematic sectional view from the side of the pump showing details of magnets located in both the lid and door stator which engage each other when the lid are locked.

Figure 11:
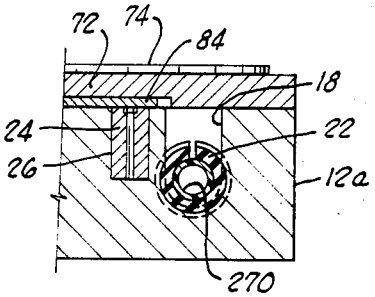

FIG. 11 shows a horizontal schematic sectional view from the front of the fixed stator member (see FIG. 3 above) showing details of a pump segment fitting or stop which restricts movement of the resilient collapsible tube in or out of the stator.

Figure 12:
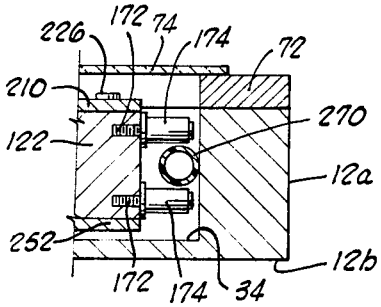

FIG. 12 is a cross-sectional view from the horizontal and within the pump viewed along the plane of the tubine of the construction and operation of the guide which operate to restrict inward and outward movement of the resilient collapsible tube within predetermined limits.

Figure 13:
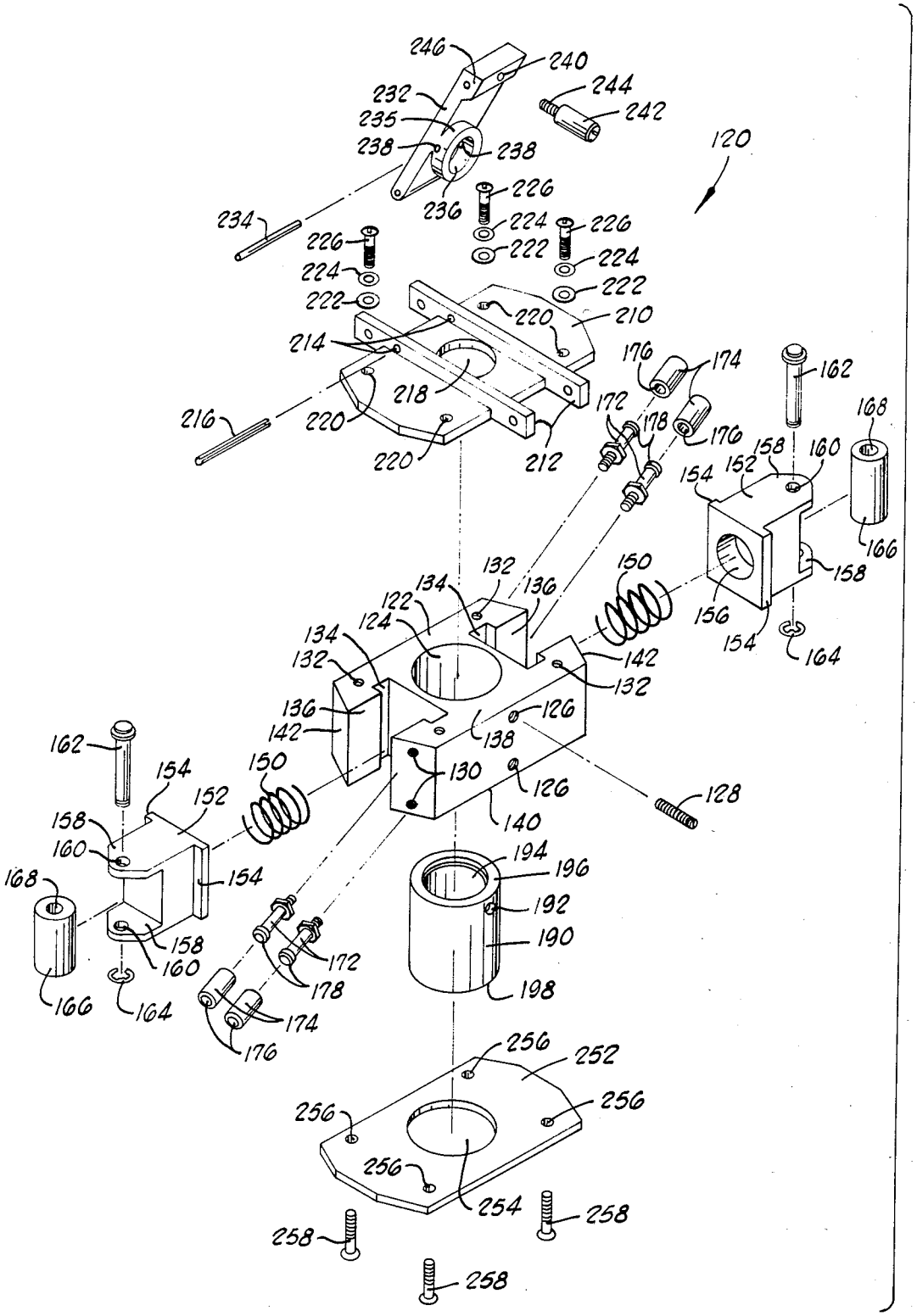

FIG. 13 is an illustrative exploded perspective view of the construction of the rotor.

Figure 14:
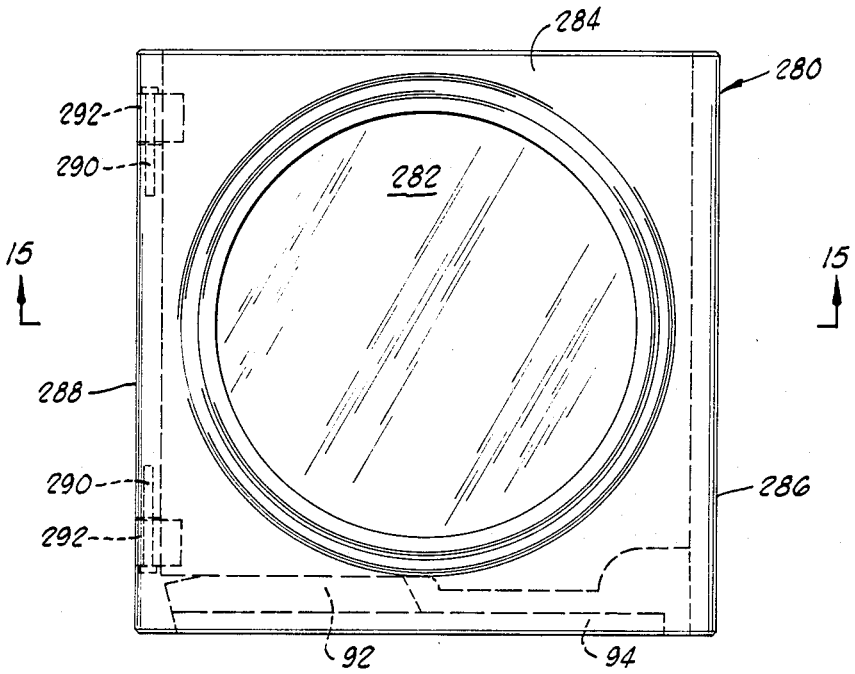

FIG. 14 is a vertical partially schematic view from above of the lid, having the hinge mechanism of FIG. 1 the construction of the hinges which connect it to the door stator and its placement on the pump, including its relationship to an off-center toggle latch.

Figure 15:
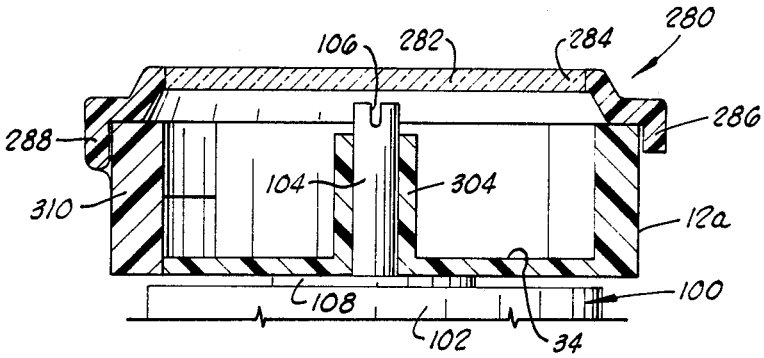

FIG. 15 is a schematic view from the horizontal of the fixed stator member, door stator, and lid vis-a-vis a DC pump a remote offset hinge (compare FIG. 2).

Figure 16:
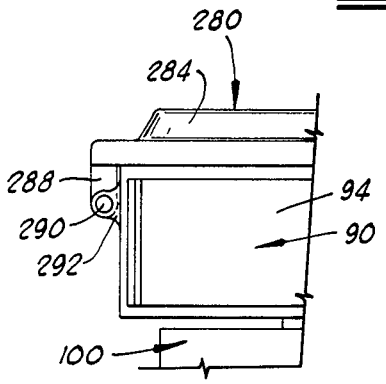

FIG. 16 discloses an alternative but preferred embodiment from the horizontal of the same remote offset hinge (compare FIG. 2) pivoting on an axis perpendicular to the axis of the rotor for connecting the lid to the door stator.

Figure 17:
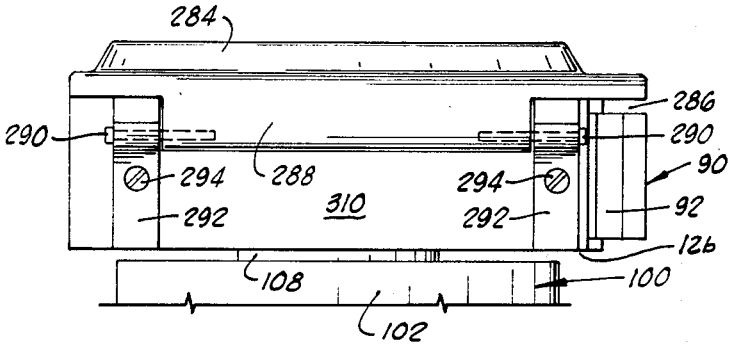

FIG. 17 is yet another horizontally partially schematic view from the rear (compare FIG. 4) of the same alternate preferred embodiment of the invention using a remote offset hinge from the rear of the pump.

DESCRIPTION OF THE PREFERRED EMBODIMENTS

The pump of the preferred embodiments herein described are taken from a novel pump to be incorporated within the REDY® 2000 continuous recirculatory dialysis machine and system (Organon Teknika Corporation, Oklahoma City, Okla.); specifically, the pump was designed for a blood dialysis flow rate of from about 275–280 ml/min. for ¼" i.d. polyvinyl chloride tubing, and 375 ml/min.) through ⅜" i.d. polyvinyl chloride tubing. The pump utilizes a 1/30 horsepower gear head DC motor (24 volts, 1.85 amps, continuous drive, Model VO3512AAB3 from Von Weise Gear Company, St. Louis, Mo., horsepower of motor is less in use; output shaft in gear box is rated 1/30 hp.) having 60 rpm at output maximum (photocell on back of motor—regular speed).

As those skilled in the art will appreciate, the flow rate for a given pump is a function of the internal diameter of the tubing selected, the speed of the rotor, the viscosity of the solution, and back pressures encountered in the system. Accordingly, when designing a blood pump, one utilizes the parameters of maximum flow rate, diameter of the tube necessary for the system, the viscosity of the solution and system back pressures, to calculate (1) the minimum circumference in the pump for operation, (2) the number of rotors required, as well as (3) the necessary speed of the pump. Once having calculated the flow rate and speed of the pump, together with the viscosity of the solution, the artisan may then calculate the power required and select the appropriate motor. These design criteria in calculations are well known to those skilled in the art. For example, where polyvinyl chloride tubing is involved from ¼" i.d. to ⅜" i.d. for a desired flow rate of blood from 275 to 375 ml/min., one may then calculate that the required radius of the pump is about 1.750" utilizing a 1/30 horsepower D.C. motor.

All ultra-high molecular weight polyethylene materials used for rollers and bearings are preferably machined from HI-FAX 1900® polyethylene having a molecular weight of $2\text{–}5\times10^6$, available from Regal Plastics Supply Company, Valley Road, Stirling, N.J. 07980).

FIG. 1 represents an overall elevational [vertical]-view of the pump and lid from above while the pump is in operation. FIG. 1 reveals a peristaltic pump unit 5 comprising a fixed stator member **12*b* (not indicated) supporting fixed stator member 12*a* having a shaft (not shown) 304 about which a rotor 120 rotates about an axis, to occlude over at least about an uninterrupted 180° a resilient collapsible tubing 270 by means of ultra-high molecular weight polyethylene rollers 166 which revolve within the fixed stator 12*a*. The inlet and outlet of the resilient collapsible tubing 270 of my design are positioned at a distance of about 2.682" apart, and the radius of the pump is designed in the occluding area to be at 1.750". The operation of the pump can clearly be seen through a transparent area 282 of window 74, inasmuch as lid member 70 defining one side of pump 5 is provided with transparent window 74 attached to rim 76 to observe the rotor. The resilient collapsible tubing 270 is constrained within predetermined limits of vertical inward and outward movement by four ultra-high molecular weight polyethylene guide/rollers 174 of which only the two rollers closest to the viewer are shown in FIG. 1. In one embodiment of the invention, lid 70 comprising surface member 72, transparent glass or plastic top 74 and rim opening 76 are attached to door stator (not shown) 50 by means of two hinges 78, located recesses 44 of lid 70. The door stator member 50 is locked to the fixed stator member 12*a* by a off-center toggle latch 90 comprising latch boon 92 and handle 94**.

FIG. 2 shows an outside elevational partly schematic view of the pump unit 5 from the horizontal (closest to a latching device area 30 and finger pull area 28) so that the relative position of fixed stator **12*a*, door stator 50 and lid 70 can be seen in proper relation while the pump is in operation. The inlet and outlet sections of the resilient collapsible tube 270 are parallel. From this angle, one may view the off-center toggle latch 90 comprising a latch boon 92 and handle 94 which is snapped shut to secure in a permanent position the door stator 50 to the fixed stator 12*a*. The door stator 50 has a rear outside wall 54 which pivotably connects to the lid 70 via two hinges 78 located in recesses 44 (not shown here, but see FIG. 1), via two hinge pins or screws 82. Lid 70 comprises a continuous member 72 interrupted by transparent top 74 adhesively secured thereto by rim 76 (not shown) so that one may view the pump while in operation. Lid 70 is so designed that when engaged on the top surface 58 of the door stator 12*a*, it also rests in close fitting engagement with the surface 36 of the fixed stator, i.e., surfaces 36 and 58 of the fixed stator member and the door stator, respectively, are in close-fitting engagement with the bottom surface of the lid when the lid is closed. The fixed stator 12*a* has a vertical surface 42 which also fits in tight-fitting engagement with the vertical surface 60 of the door stator inasmuch as the door stator must be capable of being received by the fixed stator in tight-fitting engagement upon closing of the off-center toggle latch 90. Also shown in FIG. 2 is a DC motor 100 having end plate 108 and further provided with a rotor drive 106 (not shown) for providing a shaft or axle 104 (not shown) to the base member 12*b* and rotor 120 (not shown). The body 102 of the motor may actually be quite large in a relationship to the size of the peristaltic pump. To disengage the resilient collapsible tubing 270 from the peristaltic pump unit 5, one may need only pull the off-center toggle latch 90 in a finger pull area 28 located underneath the portion of the latch 90 closest to the tubing 270, so that the door stator 50 rotatably swings away from the fixed stator member 12*b*, providing the user an easy opportunity to remove resililient collapsible tubing 270**.

FIG. 3 provides another opportunity to view the peristaltic pump from the horizontal, only this time at an elevation and along the axis of the tubing. FIG. 3 is the view of FIG. 2 but rotated 90° along the horizontal. Fixed stator member **12*a* is provided with two openings 18 and 20 for the inlet and output ends of the tubing and have orifices equally designed for accepting at either orifice one pump segment fitting/tube grip/stop 22 which secures the resilient collapsible tubing 270 in a permanent position relative to the fixed stator member 12*a*, i.e., the tube grip 22 prevents any movement of the resilient collapsible tubing 270 in or out of the fixed stator 12*a*. As is indicated in the previous figure, the top surface 36 of the fixed stator member is adapted to receive lid 70 in close-fitting engagement and specifically in close-fitting engagement with continuous member 72. FIG. 3 again illustrates the position of the transparent top 74 vis-a-vis continuous lid member 72. The fixed stator member 12***a* fits a top in end plate 108 of the DC motor 100. One can see that the off-center toggle latch 90, its latch boon 92 and hand 94 secured to the fixed stator member 12*a*.

FIG. 4 represents a horizontal elevational schematic of the peristaltic pump of the instant invention from the rear, and partially schematic, showing one embodiment of fixing the lid member 70 to the door stator 50. FIG. 2 is the same pump as FIG. 2, but rotated another 90°–180° from the view of FIG. 3. Door stator 50 is provided with rear outside wall 54 having recesses 56 adapted to accept in tight-fitting engagement hinges 78 for lid 70. The hinges 78 are secured to the door stator 50 and its rear outside wall 54 via screws 80. The top surface 58 of stator 50 is so designed to be parallel to top surface 36 (not shown) of the fixed stator member 12*a* (not shown). Lid 70 rotates about hinges 78 via two schematically-indicated hinge pins 82, or, in the alternative, rotatable screws similarly positioned. FIG. 4 again shows the relationship of lid 70, transparent top 74 and lid member 72, together with off-center toggle latch 90, its latch boon 92 and handle 94 which, when locked, secure the door stator 50 in fixed position relative to the fixed stator member 12*a*. Again it can be seen that the blood pump unit 5 rests securely atop the in plate 108 of the DC motor 100.

FIG. 5 is another horizontal partially schematic, but includes a partial cutaway view of the axle connecting the door stator 50 to the fixed stator 12*a*. Fixed stator member 12*a* again rest on top of the in plate 108 of motor 100 via base member 12*b*. The fixed stator member 12*a* has a schematically-indicated axle 16 so designed to fit in close-fitting engagement inside hub 63 having bore 64 of door stator 50 so that door stator 50 may pivot along the axle 16 parallel to the axis of the rotor 120 (not shown) when the off-center toggle latch 90 (not shown) is not secured. In FIG. 5, one may again see the relationship between the door stator 50, its recesses 56 adapted to receive two hinges 78 which secure lid 70 and its transparent top 74 through two hinge pins 82 near the top surface thereof. Door stator 50 and its hub 63 may be formed of one continuous piece of material, preferably aluminum or a suitable injection-molded glass-filled polycarbonate.

FIG. 6 shows another vertical schematic of the peristaltic pump unit 5 and its body 10 except showing in perspective the pivoting relationship of the door stator member 50 vis-a-vis fixed stator member 12*a*. In this figure, one may see hub 63 of door stator 50 having bore 64 adapted to receive in close-fitting engagement axle 16 of the fixed stator 12*a*. Again, door stator 50 is provided with rear member 52, a rear outside wall 54, recess 56 for hinge 78 for securing lid 70 consisting of continuous member 72, transparent top 74 (not shown). Schematically indicated lid 70 rests in tight-fitting engagement with the top surface 58 of door stator 50 when the door stator is swung around to fit fixed stator member 12*a* in tight engagement and off-center toggle latch 90 is secured. Hinge pins 82 secure lid 70 to door stator 50. Door stator 50 and fixed 12*a* are so constructed that upon closing they provide a continuous curved inside surface 62 in an otherwise two-dimensional plane, and being a predetermined diameter (here 1.750") for an uninterrupted 180° until a ramp 63 is encountered for both inlet and outlet sections of tubing 270. The ramps 63 are provided to eliminate shock to the pump parts and tubing. FIG. 5 further illustrates on the top surface 36 of fixed stator member 12*a* two magnets 24 adapted to receive a corresponding bar magnet 84 (not shown) provided as an inlay in lid 70. As stated above, when off-center toggle latch 90 is closed, curved surface 62 is continuous. When latch 90 is open and the door stator 50 is pivoted about the fixed stator 12*a*, tubing 270 can be easily removed from the pump, inasmuch as tube grip 22 in the tubing can be vertically removed from the pump through one pulling action. FIG. 6 provides a further illustration of the finger pull area 28 providing opportunity so that the user may grab handle 94 of off-center toggle latch 90 in order to disengage same. Off-center toggle latch 90 is secured to the fixed stator member 12*a* by a latch boon 92 which is secured via screws or adhesive (not shown) to the horizontal outside surface of fixed stator member 12*a*. Rotor 120 having two arms 158 can be seen, together with its top plate 210, with four guide rollers 174, two viewable here, for securing tubing 270 within the stator and rollers 166 for occluding tubing 270 at intervals of 180°. Rollers 166 are preferably made of the above-mentioned ultra-high molecular weight polyethylene HI-FAX 1900®, having a molecular weight of 2–5 times $10^6$. The rollers 166 are secured to arms 158 via shaft pins 162. The top surface 210 of rotor 120 is secured to the rest of the rotor by four screws 226. Rotor 120 is provided with latch door 232 revolving around latch pin 216 provided with a drive latch pin 234 adapted to receive in tight-fitting engagement a female sleeve (not shown) of shaft 104 of a DC motor 100 (not shown). The drive latch door 232 is closed via a knob/handle 242 which is threaded with an internal screw for securing itself into the latch door 232 by a threaded shaft 242. The drive latch door 232 rotates about hinge pin 216 to a possible vertical position if the user wants to remove rotor 120 from the base member 12*b* (not shown) and fixed stator member 12*a*, e.g., for cleaning. Rotor 120 has a bearing 190 for revolving close fitting engagement with the shaft 32 of base member 126 (both not shown); the drive latch pin 234 fits with the shaft 104 of the motor so that the rotor 120 may revolve continuously with rotation of shaft 104.

FIG. 7 is a schematic sectional from the horizontal (compare FIG. 2) of the pump unit 5 again showing the relationship of fixed stator member 12*a*, base member 12*b*, door stator 50 (not shown), lid 70 and rotor 120. Tubing 270 can be seen to revolve around rotor 120. In this configuration, drive latch door 232 is secured and rotates about two arms (not shown) having an internal diameter less than the diameter of the cavity of fixed stator member 5. The main body 122 of rotor 120 is provided with a bearing 190 which may rotate around shaft 32 of base member 12*b*. The top plate 210 of the rotor is so designed to fit in close-fitting engagement with drive latch door 232 when the drive latch door 232 is secured by a pin 234 to the motor shaft 104 of motor 100 and its body 102 via slot 106 in shaft 104. Again, FIG. 7 illustrates that the base member 12*b* of my pump 5 rests atop end plate 108 of motor 100. Also, FIG. 7 illustrates the relative positions of the rear outside wall 54 of door stator member 50 and two hinges 78, which operate to secure lid 70 and its main member 72 to the top surface 36 (not indicated) of fixed stator member 12*a* and top surface 58 (not indicated) of door stator 50.

Also shown in FIG. 7 is a magnet 84 located in a recess of lid 70 which operate to fit and be secured to the two magnets 24 (not shown) located in the top surface of fixed stator 12*a*. When in operation, lid 70 rotates about hinge 78 through the common axis of two hinge pins 82 so that the rotor 120 can be directly viewed.

FIG. 8 is yet another horizontal sectional schematic showing internally the operation of two spring-loaded occluding rotor 120 (not indicated). Two high molecular weight polyethylene rollers 166 occlude tubing 270 at predetermined positions; rollers 166 are provided with bores 168 (not indicated) and are adapted to be inserted in retainer wings 154 (not shown) via roller shaft pins 162 and roller shaft E-ring retainers 164. The mechanism of rotor 120 works through the inward and outward movement of pistons 152 relative to main body 140, and adapted with recesses 156 to receive springs 150. Retainer wings 154 (not shown) for the pistons 152 are adapted to be received in cavities 134 (not shown) so that the springs 150 always rest effectively against roller shaft pins 162, providing an opportunity of outward and inward movement of roller bodies 152 relative to the axis of rotor 120. Also in FIG. 8 can be seen top plate 210 of the rotor, protruding bar 212 for securing the position of latch door 232 when closed, latch door 232 and its hinge pin 234, and top plate screws 226 for fastening hot plate 210 of the rotor 120 to its main body 140 (not shown). The cavity 134 within main body 140 is so designed, again, so that outward movement of each roller piston 152 is limited so that the resilient collapsible tube 270 is only occluded through a predetermined area, e.g., 180°–200°. The ramps 63 of the fixed stator 12*a* provide my device 5 with an opportunity to have over some minimal radius most adjacent the inlet and outlet orifice 18 and 20 a greater radium (here 1.844") so that the resilient collapsible tube is only occluded through a predetermined space. All peristaltic pumps must hold occlusion with one or more rollers until another roller(s) closes the tubing on the next pump stroke.

FIG. 9 shows a schematic sectional view of the rear outside wall 54 of door stator 50 (not shown) secured by hinges 78 (located in recess 56 of the door 50) and the hinge pin screws 82 to wall 54 so as to permit lid 70 and its member 72 and transparent top 74 to rotate about the common axis of hinge pins 82. Screws 80 are shown, which are recessed in the hinges so that the hinges may be secured to a rear outside wall 54 of door stator 50.

FIG. 10 discloses another horizontal schematic sectional of the fixed stator member 12*a* vis-a-vis lid 70 when same is closed, illustrating the engagement of magnet 24 located in recess 26 of the fixed stator 12*a* (and most adjacent the orifices 18 and 20 for the tubing) adapted to receive magnet 84 located in a recess of continuous member 72 of lid 70. Recess 26 is continuous in that underneath an opening 38 is provided for electrical contact with magnets 24 so that when lid 70 is opened, causing an interruption in contact of magnets 84 and 26, an electrical circuit is broken, and the pump is stopped.

FIG. 11 is yet another horizontal sectional schematic illustration of the device, but from the front, now showing the relationship of magnets 24 (and 84 in lid 70, not indicated) in recess 26 of fixed stator member 12*a* vis-a-vis tubing 270 secured by tube grip 22 in one of two orifices 18 or 20 of the fixed stator member 12*a*. FIG. 11 also discloses the ability of tube 270 fixed by tube grip 22 to be vertically removed upon opening of the lid 70 and its main member 72 so that the tube 270 can be removed from the pump via orifices 18 ad 20 (the latter not shown).

FIG. 12 shows another horizontal sectional schematic view from within the fixed stator member 12*a* showing the operation of vertically aligned rollers 174 of rotor 120 (not indicated) operating to restrain the vertical movement of resilient collapsible tubing 270, together with a partial schematic the construction thereof. Here it is shown that rollers 174 are secured by anchor pins 172 to the main body 122 of the rotor 120; the top plate 210 and bottom plate 252 together with top plate screws 226 are shown in relation to the main body 122 of rotor 120. The top surface 34 of base member 12*b* is located at a secure distance from the bottom roller pair 174 so that there is no chance of contact which would cause friction. Lid member 72 of lid 70, together with transparent top 74 is seen as being secure to the top surface of fixed stator member 12*a*.

FIG. 13 provides an exploded illustration of the construction of the rotor 120. Rotor first comprises main body 122 having a top surface 138 and a bottom surface 140 adapted to receive in tight-fitting engagement top plate 210 and bottom plate 252, respectively. Member 122 has a precisely machined opening 124 adapted to receive a high molecular weight polyethylene main shaft bearing 190 which fits therewithin. The main body 122 is further provided with holes 12 to hold bearing retainer screws 128 (infra) and holes 130 threaded to secure guide rollers 174. Guide rollers 174 have bores 176 adapted to receive guide roller pins and anchors 172 with washers/retainers 178 in order to secure the vertical movement of tubing 270 (not shown). Main body member 122 is further provided with two cavities 134 adapted to receive and provide an outward horizontal restraint for two roller bodies 152 sliding through cavities 136. The bodies 152 provide arms 158 for occluding rollers 166. Occluding rollers 166 are provided with bores 168 adapted to receive roller axles 162, secured by "E" ring retainers 164 in order to lock same. Eight-pound roller springs 150 are positioned against the back plate of retainer rings 154 and at the opposite surface of cavity 134 of main body 122 in order to provide two surfaces of a variable distance apart for which roller bodies 152 may horizontally traverse.

As further shown in FIG. 13, main body 122 is further provided with holes 132 so that screws 226 may be inserted through holes 220 of top dry plate 210 via washers 222 and lock washers 224. Similarly, main body 122 is provided with a bottom plate 252 secured to the main body 122 by four screws 258 (three of four shown) and similar washers 222 and lock washers 224 (not shown) through holes 256. Bottom plate 252 is likewise adapted to receive in tight-fitting engagement main shaft bearing 190. Main shaft bearing 190 is provided with a hole 192 for one or more retainer screws 128 for securing same to the rotor. The bearing is further provided with an internal bore 194 adapted to receive in close-fitting engagement shaft 32/304 (infra) protruding from the floor of base member 12*b* (not shown). The bottom surface 198 of main shaft bearing 190 will therefore rest against the surface 34 of base member 12*b*. The top surface 196 of bearing 190 will comfortably fit drive latch door 232 about its protrusion 235 (infra).

Further in FIG. 13, top plate 210 is provided with two parallel bar/arms 212 for securing the latch pin 216, latch door 232 which rotates about the axis of the latch pin 216. Latch door 232 is provided with a protrusion 235 and provided with a suitable recess in same 236 to receive in fitting engagement shaft the shaft 104 of motor 100; specifically, the protrusion 235 of latch door 232 may be provided further with holes 238 to receive a drive latch pin, engagement 234 adapted to tightly receive slot 106 (not shown) in the shaft 104 of motor 100. The latch door 232 may be further provided with a protrusion 246 and hole 240 adapted to receive a drive latch door handle/know 242.

FIG. 14 shows a vertical partial schematic view of alternate door assembly/lid 280 with transparent area 282 secured by a raised area 284 so as to comfortably clear rotor 120 (not shown). In this alternate embodiment, front flap 286 may fit in snapping engagement over the front portion of fixed stator member 12*a* (not shown). This alternate embodiment is further provided with a remote offset hinge and flap 288 which rotates around common axis hinge pins 290 so that the alternate door assembly 280 may comfortably rotate vertically about the door stator 310 (not shown) once the front flap 286 of lid 280 is unsnapped from the fixed stator member 12*a*.

FIG. 15, a schematic view from the horizontal, is also illustrative for the same alternate embodiment in that it shows shaft guide 304 protruding upward from top surface 34 of base member 12*b* (not indicated) so that it may comfortably receive a high molecular weight polyethylene main shaft bearing 190 of the rotor 120 (not shown). Once again, base member 12*b* (not indicated) sits atop end plate 108 of motor 100. A cutaway portion of the main body 102 of motor is shown as the size of the motor may greatly exceed the size of pump 5.

A further view of the alternate embodiment of the door having a remote offset hinge is shown in FIG. 16 from the horizontal, showing hinge pins/axles 290 for rear hinge flap 288, together with the raised area in 284 of the alternate door assembly 280. From this angle, the off-toggle latch 90 can be seen, together with its handle 94. Pump 100 can also be viewed in perspective.

FIG. 17 is a third horizontal partially schematic view of this alternate embodiment, except from the rear, showing details of the alternate door assembly 280 vis-a-vis the door stator member 50 (not indicated). Hinge pins 290 secure rear hinge flap 288; it can be noted that where hinge flap 288 and the raised area 284 may be manufactured of one continuous piece of metal or plastic. As shown in this embodiment, hinges 292 operate in appropriate recesses of a rear hinged area (modified) of door stator member 50. Hinges 292 are secured to the rear hinged areas 310 of door stator member 50 (not indicated) by screws 294. It can also be seen in FIG. 17 the relationship of the front flap 286 and the alternate door assembly 280, as well as off-center toggle latch 90 and its latch 90 and its latch boon 92. Once again, the fixed stator member 12*a* (not shown) rests through base member 12*b* on top of end plate 108 of motor 100 and its main body 102.

The invention is exemplified by the above highly detailed preferred embodiment, which should not be construed as limiting the broad embodiments of my invention, that are for illustrative purposes only, from which those skilled in the art may depart without going beyond the teachings set forth above or beyond the scope of the appended claims and their equivalencies.

I claim:

1. A peristaltic pump, comprising:

(a) a base member;

(b) a rotor rotably disposed about an axis normal to said base member and receiving a resilient collapsible tube having inlet and outlet sections placed about said rotor;

(c) stator, comprising:

(1) a fixed stator member disposed in a permanent position relative to said rotor and said collapsible tube; and (2) a door stator member hingedly connected to said fixed stator capable of being received by said fixed stator in tight-fitting engagement, said door stator member having hingedly connected thereto a lid member defining one side of the pump, said stator having a concave face when the fixed stator member and door stator member are in tight-fitting engagement confronting the periphery of said rotor over at least an uninterrupted 180° of said periphery so as always to provide within said concave face an occludably tight engagement for said resilient collapsible tube between said stator and said rotor regardless of the orientation of the rotor, and further, whereby said door stator member and lid member may be disengaged from said rotor to facilitate removal or repair of said collapsible tube.

2. A peristaltic pump according to claim 1, wherein the rotor is secured by and rotated around axle connected to said base member said axle having a longitudinal axis normal to the base member.

3. A peristaltic pump according to claim 1, wherein the rotor has at least two arms for engaging said resilient collapsible lube in occudably tight engagement with said stator.

4. A peristaltic pump according to claim 3, wherein the arms of the rotor includes spring loaded occluding rollers, each having an axis substantially parallel to the axis of said rotor, each constrained to predetermined limits of outward and inward movement, and capable of receiving collapsible tubes of varying sizes and material durometers.

5. A peristaltic pump according to claim 3 having adjacent each arm two or more guide prefacing in the direction of rotation of each arm, each of which guide restrains the resilient collapsible tube within predetermined limits of inward and outward movement along the axis of the rotor.

6. A peristaltic pump according to claim 5, wherein the guide each comprise a roller secured about a pin normal and running parallel to the axis of the rotor.

7. A peristaltic pump according to claim 2, wherein the rotor is provided with emergency crank, comprising:

(a) lever engaging said rotor having an axis normal and running parallel to the axis of the rotor and hingedly and pivotably connected to said rotor; and (b) knob for manually cranking said rotor in an emergency.

8. A peristaltic pump according to claim 7, wherein the lever is provided with engagement for engaging on the axis of the rotor a power source for said peristaltic pump and for fixably securing in a predetermined alignment said peristaltic pump to said power source.

9. A peristaltic pump according to claim 7, wherein the engagement comprises a drive pin having an axis normal and running through the axis of the rotor when the drive pin engages and secures the power source.

10. A peristaltic pump according to claim 7, wherein the lever is hingedly and pivotably connected to said rotor by pin affixed between two protruding bar which are adapted to receive said lever in close fitting engagement so as to transfer stress of the rotor and stress from the occlusion of the resilient collapsible tube from the pin to the rotor.

11. A peristaltic pump according to claim 2, wherein the rotor has bearing which engages shaft of the base member in close fitting engagement.

12. A peristaltic pump according to claim 11, wherein the bearing comprises cylindrical sleeve rotatable about the shaft and secured to the rotor which sleeve are of a washable polyethylene having a molecular weight from about $2\times10^6$ to about $5\times10^6$ so as to avoid lubrication.

13. A peristaltic pump according to claim 4, wherein each of the spring loaded rollers comprise cylindrical sleeve rotatable about the axis of said roller, which cylindrical sleeve are of a washable polyethylene having a molecular weight from about $2\times10^6$ to about $5\times10^6$ so as to avoid lubrication.

14. A peristaltic pump according to claim 6, each roller of said guide comprises cylindrical sleeve rotatable about said pin, which cylindrical sleeve are of a washable polyethylene having a molecular weight of from about $2\times10^6$ to about $5\times10^6$ so as to avoid lubrication.

15. A peristaltic pump according to claim 1, wherein the fixed stator provides axle parallel to the axis of the rotor adapted to slidably receive in close-fitting engagement the door stator for hingedly and pivotably connecting the door stator to the fixed stator.

16. The peristaltic pump of claim 1, wherein the door stator is secured to the fixed stator by one or more off-center toggle latches.

17. The peristaltic pump of claim 1, wherein the fixed stator member has two retaining orifices for receiving the inlet and outlet sections of said resilient collapsible tube in or out of the stator.

18. The peristaltic pump of claim 1 further including a pump segment fitting permanently secured around the resilient collapsible tube.

19. The peristaltic pump of claim 1, wherein the base member and fixed stator are one piece of continuous material.

20. The peristaltic pump of claim 19, wherein the continuous material is aluminum.

21. The peristaltic pump of claim 19, wherein the continuous material is an injection-molded glass-filled polycarbonate.

22. The peristaltic pump of claim 1, wherein the lid further comprises window for viewing operation of the rotor when the pump is in use.

23. The peristaltic pump of claim 1, wherein the lid is hingedly and pivotably connected to the door stator by a remote offset hinge pivoting on an axis perpendicular to the axis of the rotor.

* * * * *